US006755987B1

(12) United States Patent
Hubesch et al.

(10) Patent No.: US 6,755,987 B1
(45) Date of Patent: Jun. 29, 2004

(54) WRINKLE REDUCING COMPOSITION

(75) Inventors: Bruno Albert Jean Hubesch, Leefdaal (BE); Christiaan Arthur Jacques Kamiel Thoen, West Chester, OH (US); Christian Leo Marie Vermote, Zwijnaarde (BE); Ricky Ah-Man Woo, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/674,223

(22) PCT Filed: Apr. 27, 1998

(86) PCT No.: PCT/US98/08127

§ 371 (c)(1),
(2), (4) Date: Oct. 27, 2000

(87) PCT Pub. No.: WO99/55949

PCT Pub. Date: Nov. 4, 1999

(51) Int. Cl.[7] ..... C11D 1/62; C11D 3/43

(52) U.S. Cl. ..... 252/8.91; 510/287; 510/289; 510/322; 510/327; 510/329; 510/330; 510/342; 510/432; 510/504; 510/515; 252/8.61

(58) Field of Search ..... 510/287, 289, 510/322, 327, 329, 330, 342, 432, 504, 515; 252/8.91, 8.61

(56) References Cited

U.S. PATENT DOCUMENTS

| | | | | | |
|---|---|---|---|---|---|
| 3,436,772 | A | | 4/1969 | Stebbins | |
| 3,600,325 | A | | 8/1971 | Kaufman et al. | |
| 3,674,688 | A | | 7/1972 | Schwartz et al. | |
| 4,187,184 | A | * | 2/1980 | Becker et al. | 252/8.8 |
| 5,100,566 | A | | 3/1992 | Agbomeirele et al. | |
| 5,399,272 | A | * | 3/1995 | Swartley et al. | 252/8.8 |
| 5,427,697 | A | * | 6/1995 | Swartley | 252/8.8 |
| 5,460,736 | A | * | 10/1995 | Trinh et al. | 252/8.8 |
| 5,500,138 | A | * | 3/1996 | Bacon et al. | 252/8.8 |
| 5,531,910 | A | * | 7/1996 | Severns et al. | 510/102 |
| 5,532,023 | A | * | 7/1996 | Vogel et al. | 427/8 |
| 5,545,340 | A | * | 8/1996 | Wahl et al. | 510/517 |
| 5,545,350 | A | * | 8/1996 | Baker et al. | 510/517 |
| 5,573,695 | A | | 11/1996 | Targosz | |
| 5,578,563 | A | * | 11/1996 | Trinh et al. | 510/513 |
| 5,968,404 | A | * | 10/1999 | Trinh et al. | 252/8.91 |
| 6,001,343 | A | * | 12/1999 | Trinh et al. | 424/76.4 |

FOREIGN PATENT DOCUMENTS

| | | |
|---|---|---|
| EP | 190839 A2 | 8/1986 |
| EP | 292309 A2 | 11/1988 |
| GB | 1542456 | 3/1979 |
| WO | WO 96/15310 A2 | 5/1996 |

OTHER PUBLICATIONS

Derwent Abstract #XP–002089278, JP1292184, Kao Corporation, Nov. 24, 1989.
Derwent Abstract #XP–002089279, JP7119044, Kao Corporation, May 9, 1995.
Derwent Abstract #XP–002089312, CN1083139, Li X, Mar. 2, 1994.
Derwent Abstract #XP–002089335, JP1168967, Lion Corporation, Jul. 4, 1989.
Derwent Abstract #XP–002089336, JP1201579, Osaka Aerosol Kogyo KK, Aug. 14, 1989.

* cited by examiner

*Primary Examiner*—Charles Boyer
(74) *Attorney, Agent, or Firm*—Mark A. Charles; Jason J. Camp; Kim William Zerby

(57) ABSTRACT

There are provided wrinkle reducing compositions and method for treating fabrics in order to improve various properties of fabrics, in particular, reduction or removal of unwanted wrinkles, by means of an aqueous composition comprising a nonionic polyhydric alcohol humectant and a water-soluble wetting agent selected from a cationic surfactant, a non-alkoxylated nonionic surfactant and an anionic surfactant.

37 Claims, No Drawings

WRINKLE REDUCING COMPOSITION

FIELD OF THE INVENTION

The present invention relates to fabric care compositions and to a method for treating fabrics in order to improve various properties of fabrics, in particular, reduction or removal of unwanted wrinkles.

BACKGROUND OF THE INVENTION

Wrinkles in fabrics are caused by the bending and creasing of the textile material which places an external portion of a filament in a yarn under tension while the internal portion of that filament in the yarn is placed under compression. Particularly with cotton fabrics, the hydrogen bonding that occurs between the cellulose molecules contributes to keeping wrinkles in place. The wrinkling of fabric, in particular clothing, is therefore subject to the inherent tensional elastic deformation and recovery properties of the fibers which constitute the yarn and fabrics.

In the modern world, with the increase of hustle and bustle and travel, there is a demand for a quick fix which will help to diminish the labor involved in home laundering and/or the cost and time involved in dry cleaning or commercial laundering. This has brought additional pressure to bear on textile technologists to produce a product that will sufficiently reduce wrinkles in fabrics, especially clothing, and to produce a good appearance through a simple, convenient application of a product.

The present invention reduces wrinkles from fabrics, including clothing, dry cleanables, and draperies, without the need for ironing. The present invention can be used on damp or dry clothing to relax wrinkles and give clothes a ready to wear look that is demanded by today's fast paced world. The present invention also essentially eliminates the need for touch up ironing usually associated with closet, drawer, and suitcase storage of garments.

When ironing is desired however, the present invention can also act as an excellent ironing aid. The present invention makes the task of ironing easier and faster by creating less iron drag. When used as an ironing aid, the composition of the present invention produces a crisp, smooth appearance.

An additional benefit of the composition of the present invention is an improved garment shape, body and crispness.

A further additional benefit to invention composition is the variety of fabric that can be treated from the more resistant to the more delicate including fabric made of cotton, polycotton, polyester, viscose, rayon, silk, wool, etc.

SUMMARY OF THE INVENTION

The present invention relates to a wrinkle reducing composition, comprising:

A. a wrinkle reducing active, comprising a nonionic polyhydric alcohol humectant and a water-soluble wetting agent selected from a cationic surfactant, a non-alkoxylated nonionic surfactant and an anionic surfactant; and B. a liquid aqueous carrier.

In another aspect of the invention, there is provided a packaged composition comprising the composition of the invention in a spray dispenser.

Still in a further aspect of the invention, there is a method of reducing the wrinkles on fabrics which comprises the steps of contacting the fabrics with a composition of the invention.

DETAILED DESCRIPTION OF THE INVENTION

A. Wrinkle Reducing Actives

1-Water-soluble wetting agent

The present invention, in one aspect uses a water-soluble wetting agent. The wetting agent for use herein are selected from a cationic surfactant, a non-alkoxylated nonionic surfactant and an anionic surfactant. Further suitable wetting agents are the zwiterrionic surfactants such as the betaine or sulphobetaine surfactants commercially available from Seppic and Albright & Wilson respectively, under the trade name of Amonyl 265® and Empigen® BB/L. These wetting agent facilitates the action of water. Indeed, the water penetrates into the fabric where it breaks hydrogen bonds between fibers resulting in fiber relaxation. By use of the wetting agent, the water action is further facilitated via the wetting properties of the water soluble surfactant.

By "water-soluble wetting agent", it is meant that the wetting agent forms substantially clear, isotropic solutions when dissolved in water at 0.2 weight percent at 25° C.

Water-soluble Cationic Surfactant

Any type of water-soluble cationic surfactant can be used to impart the wetting property. However, some water-soluble cationic surfactants and mixtures thereof are more preferred. Hence, it is preferred that the cationic surfactant is a surface-active molecule with a linear or branched hydrophobic tail and a positively charged hydrophilic head group, more preferably, the cationic surfactant for use in the present invention is a quaternary ammonium salt of formula:

$$[R^1N^+R3]X^-$$

wherein the $R^1$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester. The hydrocarbon group may be interrupted by further groups like COO, OCO, O, CO, OCOO, CONH, NHCO, OCONH and NHCOO. Each R is a $C_1$–$C_4$ alkyl or substituted (e.g., hydroxy)alkyl, or hydrogen, preferably methyl, and the counterion $X^-$ is a softener compatible anion, for example, chloride, bromide, methyl surface, etc.

The long chain group R1, of the single-long-chain-alkyl surfactant, typically contains an alkylene group having from 10 to 22 carbon atoms, preferably from 12 to about 16 carbon atoms, more preferably from 12 to 18 carbon atoms. This R1 group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. A preferred cationic surfactant of this type is N,N dimethyl-N-(2-hydroxyethyl)-N-dodecyl/tetradecyl ammonium bromide.

If the corresponding, non-quaternary amines are used, any acid (preferably a mineral or polycarboxylic acid) which is added to keep the ester groups stable will also keep the amine protonated in the compositions.

Typical disclosure of these cationic surfactants suitable for use in the present invention are the choline ester surfactants of formula:

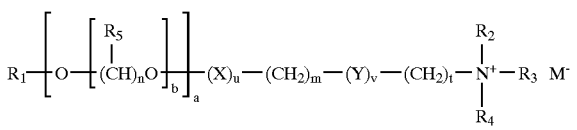

wherein $R_1$ is a $C_{10}$–$C_{22}$ linear or branched alkyl, alkenyl or alkaryl chain or $M^-$. $N^+(R_6R_7R_8)(CH_2)_s$; X and Y, independently, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$, and $R_8$ are independently selected from the group consisting of alkyl, alkenyl, hydroxyalkyl and hydroxy-alkenyl groups having from 1 to 4 carbon atoms and alkaryl groups; and $R_5$ is independently H or a $C_1$–$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion.

Preferably M is selected from the group consisting of halide, methyl sulfate, sulfate, and nitrate, more preferably methyl sulfate, chloride, bromide or iodide.

A preferred choline ester surfactant is selected from those having the formula:

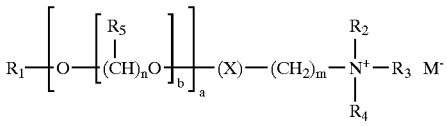

wherein $R_1$ is a $C_{10}$–$C_{22}$, preferably a $C_{12}$–$C_{14}$ linear or branched alkyl, alkenyl or alkaryl chain; X is selected from the group consisting of COO, OCO, OCOO, OCONH and NHCOO; $R_2$, $R_3$, and $R_4$ are independently selected from the group consisting of alkyl and hydroxyalkyl groups having from 1 to 4 carbon atoms; and $R_5$ is independently H or a $C_1$–$C_3$ alkyl group; wherein the value of n lies in the range of from 0 to 8, the value of b lies in the range from 0 to 20, the value of a is either 0 or 1, and the value of m is from 3 to 8.

More preferably $R_2$, $R_3$ and $R_4$ are independently selected from a $C_1$–$C_4$ alkyl group and a $C_1$–$C_4$ hydroxyalkyl group. In one preferred aspect at least one, preferably only one of $R_2$, $R_3$ and $R_4$ is a hydroxyalkyl group. The hydroxyalkyl preferably has from 1 to 4 carbon atoms, more preferably 2 or 3 carbon atoms, most preferably 2 carbon atoms. In another preferred aspect at least one of $R_2$, $R_3$ and $R_4$ is a $C_2$–$C_3$ alkyl group, more preferably two $C_2$–$C_3$ alkyl groups are present.

Highly preferred water soluble choline ester surfactants are the esters having the formula:

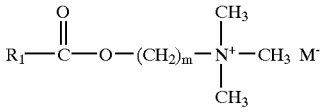

where m is from 1 to 4, preferably 2 or 3 and wherein $R_1$ is a $C_{11}$–$C_{19}$ linear or branched alkyl chain.

Particularly preferred choline esters of this type include the stearoyl choline ester quaternary methylammonium halides ($R^1$=$C_{17}$ alkyl), palmitoyl choline ester quaternary methylammonium halides ($R^1$=$C_{15}$ alkyl), myristoyl choline ester quaternary methylammonium halides ($R^1$=$C_{13}$ alkyl), lauroyl choline ester methylammonium halides ($R^1$=$C_{11}$ alkyl), cocoyl choline ester quaternary methylammonium halides ($R^1$=$C_{11}$-$C_{13}$ alkyl), tallowyl choline ester quaternary methylammonium halides ($R^1$=$C_{15}$-$C_{17}$ alkyl), and any mixtures thereof.

Most particularly preferred choline esters of this type are selected from myristoyl choline ester quaternary methylammonium halides, lauroyl choline ester methylammonium halides, cocoyl choline ester quaternary methylammonium halides, and any mixtures thereof.

Other suitable choline ester surfactants have the structural formulas below, wherein d may be from 0 to 20.

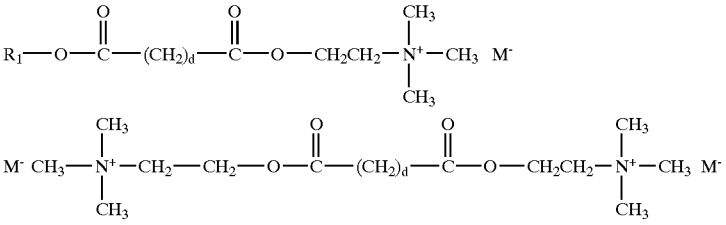

The particularly preferred choline esters, given above, may be prepared by the direct esterification of a fatty acid of the desired chain length with dimethylaminoethanol, in the presence of an acid catalyst. The reaction product is then quaternized with a methyl halide, preferably in the presence of a solvent such as ethanol, water, propylene glycol or preferably a fatty alcohol ethoxylate such as $C_{10}$–$C_{18}$ fatty alcohol ethoxylate having a degree of ethoxylation of from 3 to 50 ethoxy groups per mole forming the desired cationic material. They may also be prepared by the direct esterification of a long chain fatty acid of the desired chain length together with 2-haloethanol, in the presence of an acid catalyst material. The reaction product is then quaternized with trimethylamine, forming the desired cationic material.

Still other suitable water-soluble cationic surfactants for use in the present invention are the cationic materials with ring structures such as alkyl imidazoline, imdazolinium, pyridine, and pyridinium salts having a single $C_{12}$–$C_{30}$ alkyl chain can also be used.

Some alkyl imidazolinium salts useful in the present invention have the general formula:

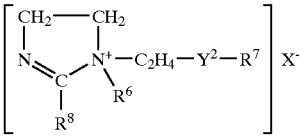

wherein $Y^2$ is —C(O)—O—, —O—(O)—C—, —C(O)—N(R5), or —N(R5)—C(O)— in which R5 is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

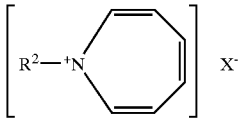

wherein $R^2$ and $X^-$ are as defined above. A typical material of this type is cetyl pyridinium chloride.

Water-soluble Nonionic Surfactant

Still suitable wetting agents are the non-alkoxylated nonionic surfactants. Typical of these surfactants are the polyhydroxyfatty acid of formula:

$$R^2—C(O)—N(R^1)—Z \quad (I)$$

wherein: $R^1$ is H, $C_1$–$C_4$ hydrocarbyl, 2-hydroxy ethyl, 2-hydroxypropyl, or a mixture thereof, and $R^2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative thereof which is preferably ethoxylated or propoxylated.

Preferably, $R^1$ is $C_1$–$C_4$ alkyl, more preferably $C_1$ or $C_2$ alkyl, most preferably $C_1$ alkyl (i.e., methyl).

Preferably, $R^2$ is a straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof.

Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl. $R^2$—CO—N< can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Water-soluble Anionic Surfactant

Still suitable wetting agents are the anionic surfactants. Suitable anionic surfactants for the purpose of the invention include the alkyl sulphates ($RSO_4$), alkyl ether sulphates ($R(OCH_2CH_2)eSO_4$), alkyl sulphonates ($RSO_3$), alkyl succinates ($ROOCCH_2CH_2COOZ$), alkyl carboxylates (RCOOM), alkyl ether carboxylates ($R(OCH_2CH_2)_e$COOM). In the formulae in brackets, R is a hydrophobic chain ($C_6$–$C_{22}$) alkyl or alkenyl, e is from 0 to 20, Z is M or R', M is H or any counterion such as those known in the art, including Na, K, Li, $NH_4$, amine, and R' is a $C_1$–$C_5$ alkyl group, possibly functionalized with hydroxyl groups, preferably $C_1$–$C_3$, most preferably methyl. Still other preferred anionic surfactants for use herein are the alkyl sulphosuccinates ($R'OOCCH_2CH(SO_3M)COOR'$) wherein R' is a hydrophobic chain ($C_6$–$C_{18}$, preferably $C_{18}$–$C_{12}$) linear or branched alkyl or alkenyl, and M is as defined hereinbefore. Preferred alkyl sulphosuccinates are commercially available from CYTEC Industries under the tradename Aerosol OT, and Aerosol AOT. Preferred among the above described anionic surfactants are selected from the alkyl sulphate surfactants, alkyl sulphosuccinate surfactants, and mixtures thereof. Preferred alkyl sulphates for use herein are selected from sodium dodecyl alkyl sulphate, sodium tallow alkyl sulphate, sodium lauryl sulphate, sodium octyl sulphate and mixtures thereof. Preferred commercially available compounds are Empicol® 0298/F and/or Empimin® LV33 from Albright and Wilson.

Still another preferred anionic surfactant for use herein has the general formula:

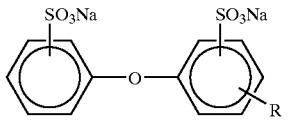

wherein R is an alkyl group. These surfactants are preferred ingredients when a cyclodextrin is present since it is compatible with the cyclodextrin. Examples of this type of surfactants are available from the Dow Chemical Company under the trade name Dowfax® wherein R is a linear or branched $C_6$–$C_{16}$ alkyl group. An example of these anionic surfactant is Dowfax 3B2 with R being approximately a linear $C_{10}$ group. These anionic surfactants are preferably not used when the antimicrobial active or preservative, etc., is cationic to minimize the interaction with the cationic actives, since the effect of both surfactant and active are diminished.

The wetting agent is present in the composition in a sufficient amount to result in an amount of from 0.001% to 5%, preferably from 0.01% to 3%, more preferably from 0.01% to 1.50% by weight of active per weight of dry fabrics.

Accordingly, typical levels of the water-soluble wetting agent in the composition are from 0.1 to 10% by weight, preferably from 0.1 to 5%, more preferably from 0.1% to 1.5% by weight of the composition.

2-Nonionic polyhydric alcohol humectant

A nonionic humectant of the polyhydric alcohol type is another essential compound of the invention. Typical of these compounds are the low molecular weight polyols.

Low molecular weight polyols with relatively high boiling points, as compared to water, are essential ingredients of the composition of the present invention.

By "low molecular weight", it is meant that the compounds preferably have a molecular weight below 1000, preferably from 50 to 500, more preferably from 55 to 200.

Preferably, these polyols are short chain. By "short chain", it is meant that the compounds have a carbon chain length of less than 10 carbon atoms, preferably less than 8 carbon atoms.

Not to be bound by theory, it is believed that the incorporation of a small amount of nonionic polyhydric alcohol humectant into the compositions containing the water-soluble wetting agent reinforces the hydrogen breaking process as well as reducing the fabric drying rate, thereby allowing more time to the fabric to relax.

Preferred polyols for use herein are selected from polyols having from 2 to 8 hydroxy groups.

Preferably the glycol used is glycerol, ethylene glycol, propylene glycol, diethylene glycol, dipropylene glycol, sorbitol, erythritol or mixtures thereof, more preferably diethylene glycol, ethylene glycol, propylene glycol, dipropylene glycol and mixtures thereof.

Some polyols, e.g., dipropylene glycol, are also useful to facilitate the solubilization of some perfume ingredients in the composition of the present invention. Both diethylene glycol and dipropylene glycol are favored for use herein as it provides non-stickiness properties on hard surfaces and/or fabrics.

The humectant is present in the composition in a sufficient amount to result in an amount of from 0.005% to 5%, preferably from 0.01% to 3%, more preferably from 0.01% to 1.50% by weight of active per weight of dry fabrics.

Typically, the humectant is added to the composition of the present invention at a level of from about 0.01% to about 10%, by weight of the composition, preferably from about 0.1% to about 3%, more preferably from about 0.1% to about 1.5%, by weight of the composition.

B. Liquid Carrier

The liquid carrier used in the composition of the present invention is an aqueous system comprising water. Optionally, but not preferably, in addition to the water, the carrier can contain a low molecular weight organic solvent that is highly soluble in water, e.g., $C_1$–$C_4$ monohydric alcohols alkylene carbonates, and mixtures thereof. Examples of these water-soluble solvents include ethanol, propanol, isopropanol, etc. Water is the main liquid carrier due to its low cost, availability, safety, and environmental compatibility. Water can be distilled, deionized, or tap water.

The level of liquid carrier in the compositions of the present invention is typically greater than 80%, preferably greater than 90%, more preferably greater than 95%, by weight of the composition. When a concentrated composition is used, the level of liquid carrier is typically from 50% to 95%, by weight of the composition, preferably from 60% to 97%, more preferably from 70% to 99%, by weight of the composition.

C. Optional Ingredients

1-Salt

A salt is an optional ingredient suitable for use in the present invention. It both contributes to the hydrogen bond breaking process produces by the water and to the reinforcement of the wetting power of the wetting agent. The salt is further believed to facilitate the dewrinkling action by maintaining a residual humidity of fibers.

The salt useful in the present invention is a compound made of alkaline and/or earth alkaline metal, and that can form hydrates upon crystallization. Typically, the salt for use in the present invention have the following formula: AM;

wherein A is a cation. This cation is an alkaline and/or earth alkaline metal, and more preferably is selected from sodium, calcium, potassium, magnesium; more preferably sodium and calcium, and wherein M is a couteranion selected from sulfate, chloride, nitrate, carbonate, borate, and carboxylates.

Preferred salts are salts selected from sodium, calcium, potassium, magnesium and mixtures thereof; more preferably salt of sodium, calcium, and mixtures thereof.

Particularly preferred salts for use herein are selected from sodium sulphate, sodium bicarbonate, sodium chloride, sodium borate, potassium sulphate, calcium chloride, sodium citrate, magnesium sulphate, and mixtures thereof, more preferably are selected from sodium sulphate, sodium bicarbonate, potassium sulphate, calcium chloride, and mixtures thereof.

The salt is present in the composition in a sufficient amount to result in an amount of from 0.005% to 5%, preferably from 0.01% to 3%, more preferably from 0.01% to 1.50% by weight of active per weight of dry fabrics.

Accordingly, typical levels of the salt in the composition are from 0.01% to about 10%, by weight of the composition, preferably from about 0.1% to about 3%, more preferably from about 0.1% to about 1.5%, by weight of the composition.

2-Lubricant

In addition to the above wetting agent and humectants described herein before which can impart a lubrication property to the fabrics, the composition may also optionally employ typical lubricating compounds.

Typical lubricants are those conventionally known as softeners and include the cationic softener and nonionic softeners.

Cationic Softeners

Typical of the cationic softening components are the quaternary ammonium compounds or amine precursors thereof as defined hereinafter.

A)-Quaternary Ammonium Fabric Softening Active Compound (1) Preferred quaternary ammonium fabric softening active compound have the formula

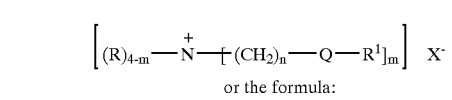

(1)

or the formula:

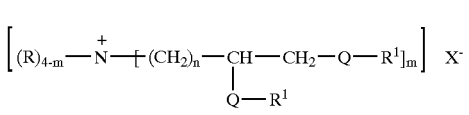

(2)

wherein Q is a functional unit having the formula:

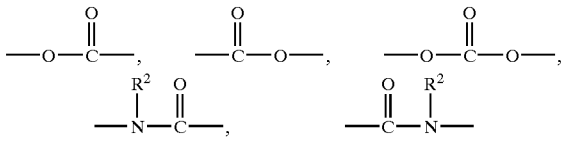

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred fabric softener active is a mixture of quaternized amines having the formula:

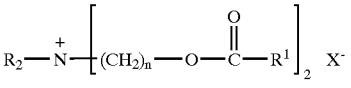

wherein R is preferably methyl; $R^1$ is a linear or branched alkyl or alkenyl chain comprising at least 11 atoms, preferably at least 15 atoms. In the above fabric softener example, the unit —$R^1$ represents a fatty alkyl or alkenyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

$$\left[(R)_{4-m}-\overset{+}{N}-[(CH_2)_n-Q-R^1]_m\right]X^-$$

wherein R, $R^1$, X, and n are the same as defined herein above for formulas (1) and (2), and Q has the formula:

$$-O-\overset{O}{\overset{\|}{C}}- \quad \text{or} \quad -\overset{H}{\overset{|}{N}}-\overset{O}{\overset{\|}{C}}-.$$

These preferred fabric softening actives are formed from the reaction of an amine with a fatty acyl unit to form an amine intermediate having the formula:

$$R-N-[(CH_2)_n-Q-R^1]_2$$

wherein R is preferably methyl, Q and $R^1$ are as defined herein before; followed by quaternization to the final softener active.

Non-limiting examples of preferred amines which are used to form the DEQA fabric softening actives according to the present invention include methyl bis(2-hydroxyethyl) amine having the formula:

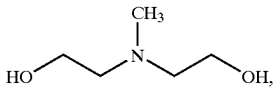

methyl bis(2-hydroxypropyl)amine having the formula:

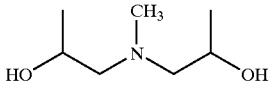

methyl(3-aminopropyl)(2-hydroxyethyl)amine having the formula:

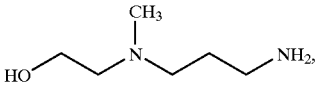

methyl bis(2-aminoethyl)amine having the formula:

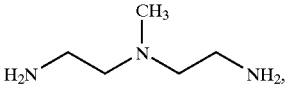

triethanol amine having the formula:

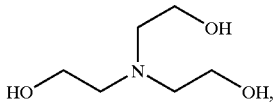

di(2-aminoethyl)ethanolamine having the formula:

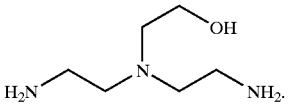

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty alkyl or alkenyl units. Likewise, the use of the term canolyl refers to a mixture of fatty alkyl or alkenyl units derived from canola oil.

In the following table are described non-limiting examples of suitable fabric softener according to the above formula. In this list, the term "oxy" defines a $$-\overset{O}{\overset{\|}{C}}-$$

unit, whereas the term "oxo" defines a —O— unit.

TABLE II

| Fabric Softener Actives |
|---|
| N,N-di(tallowyl-oxy-2-oxo-ethyl)-N-methyl, N-(2-hydroxyethyl) ammonium chloride; |
| N,N-di(canolyl-oxy-2-oxo-ethyl)-N-methyl, N-(2-hydroxyethyl) ammonium chloride; |
| N,N-di(tallowyloxy-2-oxo-ethyl)-N,N-dimethyl ammonium chloride; |
| N,N-di(canolyloxy-2-oxo-ethyl)-N,N-dimethyl ammonium chloride |
| N,N,N-tri(tallowyl-oxy-2-oxo-ethyl)-N-methyl ammonium chloride; |
| N,N,N-tri(canolyl-oxy-2-oxo-ethyl)-N-methyl ammonium chloride; |
| N-(tallowyloxy-2-oxo-ethyl)-N-(tallowyl)-N,N-dimethyl ammonium chloride; |
| N-(canolyloxy-2-oxo-ethyl)-N-(canolyl)-N,N-dimethyl ammonium chloride; |
| 1,2-di(tallowyloxy-oxo)-3-N,N,N-trimethylammoniopropane chloride; and |
| 1,2-di(canolyloxy-oxo)-3-N,N,N-trimethylammoniopropane chloride; |
| and mixtures of the above actives. |

Other examples of quaternay ammoniun softening compounds are methylbis(tallowamidoethyl)(2-hydroxyethyl) ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively.

Particularly preferred is N,N-di(tallowyl-oxy-2-oxo-ethyl)-N-methyl, N-(2-hydroxyethyl)ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

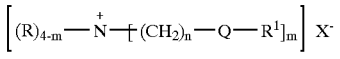

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed.

Other suitable examples of fabric softener actives are derived from fatty acyl groups wherein the terms "tallowyl" and canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

Mixtures of actives of formula (1) and (2) may also be prepared.

2)-Still other suitable quaternary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

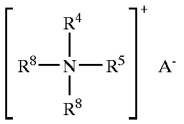

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamino alkoxylated quaternary ammonium salts having the formula:

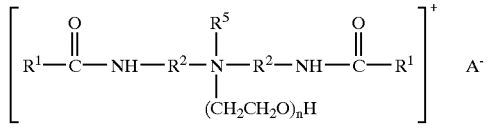

wherein n is equal to 1 to about 5, and $R^1$, $R^2$, $R^5$ and $A^-$ are as defined above;

(iii) mixtures thereof.

Examples of the above class cationic nitrogenous salts are the well-known dialkyldi methylammonium salts such as ditallowdimethylammonium chloride, ditallowdimethylammonium methylsulfate, di(hydrogenatedtallow) dimethylammonium chloride, distearyldimethylammonium chloride, dibehenyldimethylammonium chloride. Di(hydrogenatedtallow)dimethylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470, Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

B)-Amine Fabric Softening Active Compound

Suitable amine fabric softening compounds for use herein, which may be in amine form or cationic form are selected from:

(i)-Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (i) is a nitrogenous compound selected from the group consisting of the reaction product mixtures or some selected components of the mixtures.

One preferred component (i) is a compound selected from the group consisting of substituted imidazoline compounds having the formula:

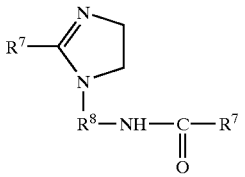

wherein $R^7$ is an acyclic aliphatic $C_{15}$–$C_{21}$ hydrocarbon group and $R^8$ is a divalent $C_1$–$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyidiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyidiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii)-softener having the formula:

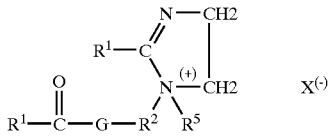

wherein each $R^2$ is a $C_{1-6}$ alkylene group, preferably an ethylene group; and G is an oxygen atom or an —NR— group; and each R, $R^1$, $R^2$ and $R^5$ have the definitions given above and $A^-$ has the definitions given above for $X^-$.

An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

(iii)-softener having the formula:

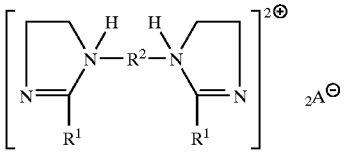

wherein R, $R^1$, $R^2$, and $A^-$ are defined as above.

An example of Compound (iii) is the compound having the formula:

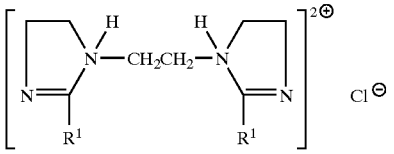

wherein $R^1$ is derived from oleic acid.

Nonionic softeners

Nonionic softener include compounds such as the fatty acid esters, preferably a partial ester, of mono- or polyhydric alcohols or anhydride thereof containing from 1 to 8 carbon atoms.

It is preferred that the fatty acid ester has at least 1 free (i.e. unesterified) hydroxyl group and at least 1 fatty acyl group.

The mono- or polyhydric alcohol portion of the ester can be represented by methanol, isobutanol, 2-ethyl hexanol, isopropanol, ethylene glycol and polyethylene glycol with a maximum of 5 ethylene glycol units, glycerol, diglycerol, xylitol, sucrose, erythritol, penta-erythritol, sorbitol or sorbitan. Ethylene glycol, glycerol and sorbitan esters are particularly preferred.

The fatty acid portion of the ester normally comprises a fatty acid having from 12 to 22 carbon atoms, typical examples being lauric acid, myristic acid, palmitic acid, stearic acid and behenic acid.

One highly preferred group of lubricant for use in the present invention is the sorbitan esters, which are esterified dihydration products of sorbitol. Sorbitol, itself prepared by the catalytic hydrogenation of glucose, can be dehydrated in well known fashion to form mixtures of 1,4- and 1,5-sorbitol anhydrides and small amounts of isosorbides. (See Brown, U.S. Pat. No. 2,322,821, issued Jun. 29, 1943). The foregoing type of complex mixtures of anhydrides of sorbitol are collectively referred to herein as "sorbitan". It will be recognized that this "sorbitan" mixture will also contain some free, uncyclized sorbitol.

The lubricants of the type employed herein can be prepared by esterifying the "sorbitan" mixture with a fatty acyl group in standard fashion, e.g. by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers: Processing and Quality Control:", Journal of the American Oil Chemists' Society, Volume 45, October 1968.

The mixtures of hydroxy-substituted sorbitan esters useful herein contain, inter alia, compounds of the following formulae, as well as the corresponding hydroxy-substituted di-esters:

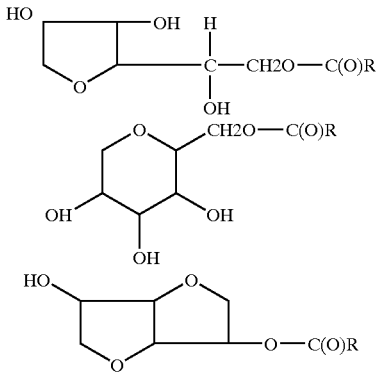

wherein the group R is a C10–C26, and higher, fatty alkyl residue. Preferably this fatty alkyl residue contains from 16 to 22 carbon atoms. The fatty alkyl residue can, of course, contain non-interfering substituents such as hydroxyl groups. Esterified hydroxyl groups can, of course, be either in terminal or internal positions within the sorbitan molecule.

The foregoing complex mixtures of esterified dehydration products of sorbitol (and small amounts of esterified sorbitol) are collectively referred to herein as "sorbitan esters". Sorbitan mono- and di-esters of lauric, myristic, palmitic, stearic and behenic (docosanoic) acids are particularly useful herein as softening agents and also can provide an anti-static benefit to fabrics. Mixed sorbitan esters, e.g. mixtures of the foregoing esters, and mixtures prepared by esterifying sorbitan with fatty acid mixtures such as the mixed tallow fatty acids, are useful herein and are economically attractive. Unsaturated C10–C22 sorbitan esters, e.g. sorbitan monooleate, usually are present in such mixtures in low concentration.

The term "alkyl" as employed herein to describe the sorbitan esters encompasses both the saturated and unsaturated hydrocarbyl ester side chain groups.

Certain derivatives of the sorbitan esters herein, especially the "lower" ethoxylates thereof (i.e. mono-, di- and tri-esters) wherein one or more of the unesterified —OH groups contain one to about 20 oxyethylene moieties (Tweens®) are also useful in the composition of the present invention. Therefore, for purposes of the present invention, the term "sorbitan ester" includes such derivatives.

Preparation of the sorbitan esters can be achieved by dehydrating sorbitol to form a mixture of anhydrides of the type set forth above, and subsequently esterifying the mixture using, for example, a 1:1 stoichiometry for the esterification reaction. The esterified mixture can then be separated into the various ester components. Separation of the individual ester products is, however, difficult and expensive.

Accordingly, it is easier and more economical not to separate the various esters, using instead the esterified mixture as the sorbitan ester component. Such mixtures of esterified reaction products are commercially available under various tradenames e.g. Span® Such sorbitan ester mixtures can also be prepared by utilizing conventional interesterification procedures.

For the purposes of the present invention, it is preferred that a significant amount of di- and tri-sorbitan esters are present in the ester mixture. Ester mixtures having from 20%–50% mono-ester, 25% to 50% di-ester and 10%–35% of tri- and tetra-esters are preferred. The material which is sold commercially as sorbitan mono-ester (e.g. monostearate) does in fact contain significant amounts of di- and tri-esters and a typical analysis of sorbitan monostearate indicates that it comprises ca.27% mono-, 32% di- and 30% tri- and tetra esters. Commercial sorbitan mono-stearate therefore is a preferred material.

Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein. Other useful alkyl sorbitan esters for use in the softening compositions herein include sorbitan monolaurate, sorbitan monomyristate, sorbitan monopolmitate, sorbitan mono-behenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallow-alkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction, It is to be recognized, of course, that commercial materials prepared in this manner will comprise mixtures usually containing minor proportions of uncyclized sorbitol, fatty acids, polymers, isosorbide structures, and the like.

It is also to be recognized that the sorbitan esters employed herein can contain up to about 15% by weight of esters of the C20–C26, and higher, fatty acids, as well as minor amounts of C8, and lower, fatty esters.

Other fatty acid partial esters useful in the present invention are xylitol monopalmitate, pentaerythritol monostearate, sucrose monostearate, glycerol monostearate and ethylene glycol monostearate. As with the sorbitan esters, commercially available mono-esters normally contain substantial quantities of di- or tri-esters.

The glycol esters are also highly preferred. These are the mono-, di- or tri-esters of glycerol and fatty acids of the class described above.

Commercial glyceryl monostearate, which may contain a proportion of the di- and tristearates, is especially preferred.

Another class of suitable nonionic lubricants are the cyclomethicones such as described in EP636356.

The above-discussed nonionic compounds are correctly termed "lubricating agents", because, when the compounds are correctly applied to a fabric, they do impart a soft, lubricious feel to the fabric.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. : 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., all of said documents being incorporated herein by reference.

Of course, the term "lubricating agent" can also encompass mixed softening active agents.

Preferred lubricating agent among the one disclosed above are the quaternary ammonium compound disclosed under (A) and the cyclomethicones.

The lubricating agent is present in the composition in a sufficient amount to result in an amount of from 0.005% to 5%, preferably from 0.01% to 3%, more preferably from 0.01% to 1.50% by weight of active per weight of dry fabrics.

Typically, the lubricating agent is added to the composition of the present invention at a level of from about 0.01% to about 10%, by weight of the composition, preferably from about 0.1% to about 3%, more preferably from about 0.1% to about 1.5%, by weight of the composition.

3-Cyclodextrin

In a preferred aspect of the invention, the composition of the invention comprises an optional cyclodextrin. This will impart the composition with odour absorbing properties, which is especially useful for application on inanimate surfaces to control the malodour, whilst not being detrimental to the dewrinkling performance of the composition.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is faidy hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatized cyclodextrins.

Preferably, the solution of the present invention is clear. The term "clear" as defined herein means transparent or translucent, preferably transparent, as in "water clear," when observed through a layer having a thickness of less than about 10 cm.

Preferably, the cyclodextrins for use herein are highly water-soluble such as, alpha-cyclodextrin and/or derivatives thereof, gamma-cycladextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No: 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-clodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-syclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alphacyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

It is further believed that a small amount of low molecular weight polyol as defined herein before into the composition comprising the uncomplexed cyclodextrin enhances the formation of the cyclodextrin inclusion complexes as the fabric dries. Further, the incorporation of such polyol provides an improved odor control performance of the composition of the present invention comprising said cyclodextrin.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes.

Cyclodextrin compositions prepared by processes that result in a level of such polyols are highly desirable, since they can be used without removal of the polyols.

Diethylene glycol is particularly useful in the presence of the uncomplexd cyclodextrin. Indeed, it has been found to enhance the removal of small malodour molecules.

The preferred weight ratio of low molecular weight cyclodextrin to polyol is from about 50:1 to about 1:11, more preferably from about 20:1 to about 1:1, even more preferably from about 10:1 to about 1:1, and most preferably from about 5:1 to about 1:1.

For controlling odor on fabrics, the composition is preferably used as a spray. It is preferable that the usage compositions of the present invention contain low levels of cyclodextrin so that a visible stain does not appear on the fabric at normal usage levels. Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.2% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

Concentrated compositions can also be used in order to deliver a less expensive product. When a concentrated product is used, i.e., when the level of cyclodextrin used is from about 3% to about 20%, more preferably from about 5% to about 10%, by weight of the concentrated composition, it is preferable to dilute the concentrated composition before treating fabrics in order to avoid staining. Preferably the concentrated cyclodextrin composition is diluted with about 50% to about 6000%, more preferably with about 75% to about 2000%, most preferably with about 100% to about 1000% by weight of the concentrated composition of water. The resulting diluted compositions have usage concentrations of cyclodextrin as discussed hereinbefore, e.g., of from about 0.1% to about 5%, by weight of the diluted composition.

4. Alkoxylated Surfactant

An alkoxylated surfactant is a suitable optional ingredient for use in the present invention. It provides a low surface tension that permits the composition to spread readily and more uniformly on hydrophobic surfaces like polyester and nylon. Said surfactant is preferably included when the composition is used in a spray dispenser in order to enhance the spray characteristics of the composition and allow the composition to distribute more evenly, and to prevent clogging of the spray apparatus. The spreading of the composition also allows it to dry faster, so that the treated material is ready to use sooner. For concentrated compositions, the surfactant facilitates the dispersion of many actives such as antimicrobial actives and perfumes in the concentrated aqueous compositions.

Nonlimiting examples of nonionic alkoxylated surfactants include addition products of ethylene oxide with fatty alcohols, fatty acids, fatty amines, etc. Optionally, addition products of propylene oxide with fatty alcohols, fatty acids, fatty amines may be used.

Suitable compounds are surfactants of the general formula:

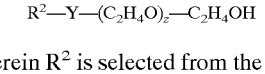

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups preferably having a hydrocarbyl chain length of from 6 to 20, preferably from 8 to 18 carbon atoms. More preferably the hydrocarbyl chain length is from 10 to 18 carbon atoms. In the general formula for the ethoxylated nonionic surfactants herein, Y is —O—, —C(O)O—, —C(O)N(R)—, or —C(O)N(R)R—, in which R, when present, is $R^2$ or hydrogen, and z is at least 2, preferably at least 4, more preferably from 5 to 11.

The nonionic ,surfactants herein are characterised by an HLB (hydrophilic-lipophilic balance) of from 7 to 20, preferably from 8 to 15. Of course, by defining $R^2$ and the number of ethoxylate groups, the HLB of the surfactant is, in general, determined. However, it is to be noted that the nonionic ethoxylated surfactants useful herein contain relatively long chain $R^2$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

a. Straight-Chain, Primary Alcohol Alkoxylates

The tri-, penta-, hepta-ethoxylates of dodecanol, and tetradecanol are useful surfactants in the context of this invention. The ethoxylates of mixed natural or synthetic alcohols in the "coco" chain length range are also useful herein. Commercially available straight-chain, primary alcohol alkoxylates for use herein are available under the tradename Marlipal® 24/70, Marlipal 24/100, Marlipal 24/150 from Huls, and Genapol® C-050 from Hoechst.

b. Straight-Chain, Secondary Alcohol Alkoxylates

The tri-, penta-, hepta-ethoxylates of 3-hexadecanol, 2-octadecanol, 4-eicosanol, and 5-eicosanol are useful surfactants in the context of this invention.

A commercially available straight-chain secondary alcohol ethoxylate for use herein is the material marketed under the tradename Tergitol 15-S-7 from Union Carbide, which comprises a mixture of secondary alcohols having an average hydrocarbyl chain length of 11 to 15 carbon atoms condensed with an average 7 moles of ethylene oxide per mole equivalent of alcohol. Still another suitable commercially available straight-chain secondary alcohol ethoxylate for use herein is the material marketed under the tradename Softanol obtainable from BP Chemicals Ltd. or Nippon Catalytic of Japan. Particularly useful herein are Softanol 50, Softanol 90, which comprises a mixture of linear secondary alcohol having an average hydrocarbyl chain length of 11 to 16 carbon atoms condensed with an average of 5 to 10 moles of ethylene oxide per mole equivalent of alcohol.

c. Alkyl Phenol Alkoxylates

Suitable alkyl phenol alkoxylates are the polyethylene oxide condensates of alkyl phenols, e.g., the condensation products of alkyl phenols having an alkyl or alkenyl group containing from 6 to 20 carbon atoms in a primary, secondary or branched chain configuration, preferably from 8 to 12 carbon atoms, with ethylene oxide, the said ethylene oxide being preferably present in amounts equal to 3 to 11 moles of ethylene oxide per mole of alkyl phenol. The alkyl substituent in such compounds may be derived from polymerized propylene, diisobutylene, octane, and nonane.

Examples of this type of nonionic surfactants include Triton N-57® a nonyl phenol ethoxylate (5EO) from Rohm & Haas, Dowfax® 9N5 from Dow and Lutensol® AP6 from BASF.

d. Olefinic Alkoxylates

The alkenyl alcohols, both primary and secondary, and alkenyl phenols corresponding to those disclosed immediately hereinabove can be ethoxylated and used as surfactants.

Commercially available olefinic alkoxylates for use herein are available under the tradename Genapol O-050 from Hoechst.

e. Branched Chain Alkoxylates

Branched chain primary and secondary alcohols (or Guerbet alcohols) which may be available from the well-known "OXO" process or modification thereof can be ethoxylated.

Particularly preferred among these ethoxylates of the primary OXO alcohols are the surfactants marketed under the name Lutensol by BASF or Dobanol by the Shell Chemicals, U.K., LTD. The preferred Dobanols are primary alcohols with hydrocarbyl groups of 9 to 15 carbon atoms, with the majority having a hydrocarbyl group of 13 carbon atoms. Particularly preferred are Dobanols with an average degree of ethoxylation of 3 to 11, and preferably 7 on the average.

An example of this type of material is an aliphatic alcohol ethylene oxide condensate having from 3 to less than 9 moles of ethylene oxide per mole of aliphatic alcohol, the aliphatic alcohol fraction having from 9 to 14 carbon atoms. Other examples of this type of nonionic surfactants include certain of the commercially available Dobanol®, Neodol® marketed by Shell, Lutensol® from BASF, or Lial® from Enichem. For example Dobanol® 23.5 (C12–C13 EO5), Dobanol® 91.5 (C9–C11 EO 5), Neodol 45 E5, and Lial-145.7 EO (oxo C 14 15 alcohol+7.0 mol of EO), Lial 111 EO 6 and Isalchem 123 series from Enichem.

Other suitable nonionic alkoxylated surfactants are alkyl amines alkoxylated with at least 5 alkoxy moieties. Typical of this class of compounds are the surfactants derived from the condensation of ethylene oxide with an hydrophobic alkyl amine product. Preferably the hydrophobic alkyl group, has from 6 to 22 carbon atoms. Preferably, the alkyl amine is alkoxylated with 10 to 40, and more preferably 20 to 30 alkoxy moieties.

Example of this type of nonionic surfactants are the alkyl amine ethoxylate commercially available under the tradename Genamin from Hoechst. Suitable example for use herein are Genamin C-100, Genamin O-150, and Genamin S-200.

Still other suitable type of nonionic surfactant among this class are the N,N',N'-polyoxyethylene(12)-N-tallow 1,3 diaminopropane commercialised under the tradename Ethoduomeen T22 from Akzo, and Synprolam from ICI.

Further suitable nonionic surfactants are the alkyl amide surfactants.

Further nonlimiting examples of nonionic alkoxylated surfactants include the surfactant which are cyclodextrin-compatible, that is it should not substantially form a complex with the cyclodextrin so as to diminish performance of the cyclodextrin and/or the surfactant. Complex formation diminishes both the ability of the cyclodextrin to absorb odors and the ability of the surfactant to lower the surface tension of the aqueous composition. This include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

Non limiting examples of surfactants of this type include:

Pluronic Surfactants with the general formula $H(EO)_n(PO)_m(EO)_nH$, wherein EO is an ethylene oxide group, PO is a propylene oxide group, and n and m are numbers that indicate the average number of the groups in the surfactants. Typical examples of cyclodextrin/compatible Pluronic surfactants are:

| Name | Average MW | Average n | Average m |
|---|---|---|---|
| L-44 | 2,200 | 10 | 23 |
| L-43 | 1,850 | 6 | 22 |
| F-38 | 4,700 | 43 | 16 |
| P-84 | 4,200 | 19 | 43, |

and mixtures thereof.

Tetronic Surfactants with the general formula:

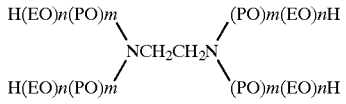

wherein EO, PO, n, and m have the same meanings as above. Typical examples of cyclodextrin-compatible Tetronic surfactants are:

| Name | Average MW | Average n | Average m |
|---|---|---|---|
| 901 | 4,700 | 3 | 18 |
| 908 | 25,000 | 114 | 22, |

and mixtures thereof.

"Reverse" Pluronic and Tetronic surfactants have the following general formulas:

Reverse Pluronic Surfactants $H(PO)_m(EO)_n(PO)_mH$

Reverse Tetronic Surfactants

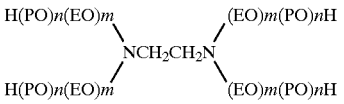

wherein EO, PO, n, and m have the same meanings as above. Typical examples of Reverse Pluronic and Reverse Tetronic surfactants are:

| Name | Average MW | Average n | Average m |
|---|---|---|---|
| Reverse Pluronic surfactants: | | | |
| 10 R5 | 1,950 | 8 | 22 |
| 25 R1 | 2,700 | 21 | 6 |
| Reverse Tetronic surfactants | | | |
| 130 R2 | 7,740 | 9 | 26 |
| 70 R2 | 3,870 | 4 | 13 |

and mixtures thereof.

The silicone surfactants

A preferred class of nonionic alkoxylated surfactants are the polyalkyleneoxide polysiloxanes having a dimethyl polysiloxane hydrophobic moiety and one or more hydrophilic polyalkylene side chains. Examples of this type of surfactants are the Silwet® surfactants which are available OSi Specialties, Inc., Danbury, Conn., and have the general formula:

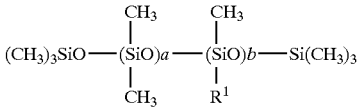

wherein a+b are from about 1 to about 50, preferably from about 3 to about 30, more preferably from about 10 to about 25, and $R^1$ is mainly one or more random poly (ethyleneoxide/propyleneoxide)copolymer groups having the general formula:

$$—(CH_2)_nO(C_2H_4O)_c(C_3H_6O)_dR^2$$

wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group.

Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |

-continued

| Name | Average MW | Average a + b | Average total c |
|---|---|---|---|
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_4O$) in the polyether chain ($R^1$) must be sufficient to render the polyalkyleneoxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7657, and mixtures thereof. Besides surface activity, polyalkyleneoxide polysiloxane surfactants can also provide other benefits, such as antistatic benefits, lubricity and softness to fabrics.

The preparation of polyalkyleneoxide polysiloxanes is well known in the art. Polyalkyleneoxide polysiloxanes of the present invention can be prepared according to the procedure set forth in U.S. Pat. No. 3,299,112, incorporated herein by reference. Typically, polyalkyleneoxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

Typical levels of nonionic alkoxylated surfactants in usage compositions are from about 0.01% to about 2%, preferably from about 0.03% to about 0.6%, more preferably from about 0.05% to about 0.3%, by weight of the composition. Typical levels of nonionic alkoxylated surfactants in concentrated compositions are from about 0.1% to about 8%, preferably from about 0.2% to about 4%, more preferably from about 0.3% to about 3%, by weight of the concentrated composition.

5-Antimicrobial active

The composition may suitably use an optional solubilized, water-soluble antimicrobial active, useful in providing protection against organisms that become attached to the treated material. The free, uncomplexed antimicrobial, e.g., antibacterial, active provides an optimum antibacterial performance.

Sanitization of fabrics can be achieved by the compositions of the present invention containing, antimicrobial materials, e.g., antibacterial halogenated compounds, quaternary compounds, and phenolic compounds.

Biguanides. Some of the more robust antimicrobial halogenated compounds which can function as disinfectants/sanitizers as well as finish product preservatives (vide infra), and are useful in the compositions of the present invention include 1,1'-hexamethylene bis(5-(p-chlorophenyl) biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.01% to about 0.1%, by weight of the usage composition. In some cases, a level of from about 1% to about 2% may be needed for virucidal activity.

Other useful biguanide compounds include Cosmoci® CQ®, Vantocil® IB, including poly(hexamethylene biguanide)hydrochloride. Other useful cationic antimicrobial agents indude the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane) dihydrochloride; 1,6-di-($N_1$,$N_1$'-phenyldiguanido-$N_5$,$N_5$')-hexane tetrahydrochloride; 1,6-di-($N_1$,$N_1$'-phenyl-$N_1$,$N_1$'-methyldiguanido-$N_5$,$N_5$')-hexane dihydrochloride; 1,6-di ($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di[$N_1$,$N_1$'-.beta.-(p-methoxyphenyl)diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$,$N_5$')hexane dihydrochloride;.omega.:.omega.'-di-($N_1$,$N_1$'-phenyldiguanido-$N_5$,$N_5$')-di-n-propyl ether dihydrochloride;.omega:omega'-di($N_1$,$N_1$'-p-chlorophenyldiguanido-$N_5$,$N_5$')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$')hexane dihydrochloride; 1,6-di($N_1$,$N_1$'-2,4,5-trichlorophenyldiguanido-$N_5$,$N_5$') hexane tetrahydrochloride; 1,6-di[$N_1$,$N_1$'-.alpha.-(p-chlorophenyl)ethyldiguanido-$N_5$,$N_5$'] hexane dihydrochloride;.omega.:.omega.'di($N_1$,$N_1$'-p-chlorophenyl diguanido-$N_5$,$N_5$') m-xylene dihydrochloride; 1,12-di($N_1$,$N_1$'-p-chlorophenyl diguanido-$N_5$,$N_5$')dodecane dihydrochloride; 1,10-di($N_1$,$N_1$'-phenyldiguanido-$N_5$,$N_5$')-decane tetrahydrochloride; 1,12-di($N_1$,$N_1$'-phenyldiguanido-$N_5$,$N_5$')dodecane tetrahydrochloride; 1,6-di($N_1$,$N_1$'-o-chlorophenyldiguanido-$N_5$,$N_5$')hexane dihydrochloride; 1,6-di($N_1$,$N_1$'-p-chlorophenyldiguanido-$N_5$,$N_5$')-hexane tetrahydrochloride; ethylene bis(1-tolyl biguanide); ethylene bis(p-tolyl biguanide); ethylene bis(3,5-dimethylphenyl biguanide); ethylene bis(p-tert-amylphenyl biguanide); ethylene bis(nonylphenyl biguanide); ethylene bis(phenyl biguanide); ethylene bis(N-butylphenyl biguanide); ethylene bis(2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis(phenylbiguanide); trimethylene bis(o-tolyl biguanide); N-butyl trimethylene bis (phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred antimicrobials from this group are 1,6-di-($N_1$,$N_1$'-phenyldiguanido-$N_5$,$N_5$')-hexane tetrahydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetra hydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$')dodecane dihydrochloride; 1,6-di($N_1$,$N_1$'-o-chlorophenyldiguanido-$N_5$,$N_5$')hexane dihydro chloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl)ethyldiguanido-$N_5$,$N_5$']hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$')dodecane dihydrochloride; 1,6-di($N_1$,$N_1$'-o-chlorophenyldiguanido-$N_5$,$N_5$')hexane dihydrochloride; 1,6-di($N_1$,$N_1$'-p-chlorophenyldiguanido-$N_5$,$N_5$')-hexane tetrahydro chloride; and mixtures thereof. As stated hereinbefore, the bis biguanide of choice is chlorhexidine its salts, e.g., digluconate, dihydrochloride, diacetate, and mixtures thereof.

Quaternary Compounds. A wide range of quaternary compounds can also be used as antimicrobial actives, in conjunction with the preferred surfactants, for compositions of the present invention that do not contain cyclodextrin. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco-Sherex), and Hyamine® (available from Lonza); (2) dialkyl quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Typical concentrations for biocidal effectiveness of these quaternary compounds range from about 0.001% to about 0.8%, preferably from about 0.005% to about 0.3%, more preferably from about 0.01% to 0.2%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

Other preservatives which are conventional in the art, such as described in U.S. Pat. No. 5,593,670 incorporated herein by reference, may also be used herein.

The surfactants, when added to the antimicrobials tend to provide improved antimicrobial action. This is especially true for the siloxane surfactants, and especially when the siloxane surfactants are combined with the chlorhexidine antimicrobial actives.

6-Perfume

The composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from about 0% to about 0.5%, preferably from about 0.003% to about 0.3%, more preferably from about 0.005% to about 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b).

(a). Hydrophilic Perfume Ingredients

The hydrophilic perfume ingredients are more soluble in water, have less of a tendency to complex with the cyclodextrins, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydratropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobornyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara-yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b). Low Odor Detection Threshold Perfume Ingredient

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

7-Soil Release Agent

Soil Release agents are desirably used in compositions of the instant invention. Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al., issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. No. 4,240,918; U.S. Pat. No. 4,787,989; U.S. Pat. No. 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K.K., SOKALAN type of material, e.g., SOKALAN HP-22, available from BASF (Germany), ZELCON 5126 (from Dupont) and MILEASE T (from ICI).

8-Pro-perfume

The composition may also comprises ingredient useful for providing a long and lasting release of a perfume material. Typical disclosure can be found in WO95/04809, WO96/02625, PCT US97/14610 filed 19 Aug. 1997 and claiming priority of 19 Aug. 1996, and EP-A-0,752,465.

Typical level of incorporation of the perfume are from 0.01% to 15% by weight of the composition.

9-pH

An optional requirement of the compositions according to the present invention is that the pH is greater than 3, preferably between 3 and 12. This range is preferred for fabric safety. When a lubricant of the diester quaternary ammonium type is used, it is most preferred to have the conventional pH range, as measured in the neat compositions at 20° C., of from 2.0 to 5, preferably in the range of 2.5 to 4.5, preferably about 2.5 to about 3.5. The pH of these compositions herein can be regulated by the addition of a Bronsted acid.

10-Other Optional Ingredients

The present invention can include optional components conventionally used in textile treatment compositions, for example, colorants, preservatives, bactericides, optical brighteners, opacifiers, anti-shrinkage agents, germicides, fungicides, anti-oxidants, dye fixing agent, enzymes, chelating agents, metallic salts to absorb amine and sulfur-containing compounds and selected from the group consisting of copper salts, zinc salts, and mixtures thereof, color protectors like polyethylene imine and its alkoxylated derivatives, and the like. The compositions are preferably free of any material that would soil or stain fabric, and are also substantially free of starch. Typically, there should be less than about 0.5%, by weight of the composition, preferably less than about 0.3%, more preferably less than about 0.1%, by weight of the composition, of starch and/or modified starch.

D. Form of the Composition

The composition can be provided in any suitable form such as spray, foam, gel or any other suitable form for liquid aqueous compositions, preferably the composition is in the form of a spray. Preferably, when sprayed, the liquid composition which is applied on the fabric will have particle sizes in the range of 8 to 100 μm, preferably from 10–60 μm (more preferably from 20–60 μm) for automatic sprayer, and preferably from 50–100 μm for manually activated sprayer. Accordingly, there is provided a packaged composition comprising the composition, in a spray dispenser.

E. Packaging

In another aspect of the invention, a packaged composition is provided that comprises a packaged composition comprising a wrinkle reducing composition comprising a wrinkle reducing active which contains a nonionic polyhydric alcohol humectant and a water-soluble wetting agent selected from a cationic surfactant, a non-alkoxylated nonionic surfactant and an anionic surfactant; a liquid carrier, and a spray dispensing device.

The dilute compositions, i.e., compositions containing from about 0.1% to about 5%, by weight of the composition, of wrinkle reducing active, of the present invention are preferably sprayed onto fabrics and therefore are typically packaged in a spray dispenser. The spray dispenser can be any of the manually activated means for producing a spray of liquid droplets as is known in the art, e.g. trigger-type, pump-type, electrical spray, hydraulic nozzle, sonic nebulizer, high pressure fog nozzle, non-aerosol self-pressurized, and aerosol-type spray means. Automatic activated means can also be used herein. These type of automatic means are similar to manually activated means with the exception that the propellant is replaced by a compressor. It is preferred that at least about 70%, more preferably, at least about 80%, most preferably at least about 90% of the droplets have a particle size of smaller than about 200 microns.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 5 to about 100 p.s.i.g., more preferably from about 10 to about 60 p.s.i.g. The one important requirement concerning the dispenser is that It be provided with a valve member which will permit the wrinkle reducing composition contained in the dispenser to be dispensed in the form of a spray of very fine, or finely divided, particles or droplets. The aerosol dispenser utilizes a pressurized sealed container from which the wrinkle reducing composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, are not preferred. Halogenated hydrocarbon propellants such as chlorofluoro hydrocarbons have been alleged to contribute to environmental problems. Preferred propellants are compressed air, nitrogen, inert gases, carbon dioxide, etc. A more complete description of commercially available aerosol-spray dispensers appears in U.S. Pat. No. : 3,436,772, Stebbins, issued Apr. 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of odor-absorbing fluid product and of causing said product to be dispensed. A more complete description of self-pressurized spray dispensers can be found in U.S. Pat. Nos. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the wrinkle reducing composition from the propellant (preferably compressed air or nitrogen), as is disclosed in U.S. Pat. No. 4,260,110, issued Apr. 7, 1981, incorporated herein by reference. Such a dispenser is available from EP Spray Systems, East Hanover, N.J.

More preferably, the spray dispenser is a non-aerosol, manually activated, pump-spray dispenser. Said pump-spray dispenser comprises a container and a pump mechanism which securely screws or snaps onto the container. The container comprises a vessel for containing the wrinkle reducing composition to be dispensed.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. Other materials can include stainless steel. A more complete disclosure of commercially available dispensing devices appears in: U.S. Pat. No. : 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. The trigger-spray dispenser does not incorporate a propellant gas. The trigger-spray dispenser herein is typically one which acts upon a discrete amount of the wrinkle reducing composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references are incorporated herein by reference.

A broad array of trigger sprayers or finger pump sprayers are suitable for use with the compositions of this invention. These are readily available from suppliers such as Calmar, Inc., City of Industry, California; CSI (Continental Sprayers, Inc.), St. Peters, Mo.; Berry Plastics Corp., Evansville, Ind.—a distributor of Guala® sprayers; or Seaquest Dispensing, Cary, Ill.

The preferred trigger sprayers are the blue inserted Guala® sprayer, available from Berry Plastics Corp., the Calmar TS800-1A® sprayers, available from Calmar Inc., or the CSI T7500® available from Continental Sprayers, Inc., because of the fine uniform spray characteristics, spray volume, and pattern size. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or polyethylene terephthalate.

For smaller four fl-oz. size (about 118 ml), a finger pump can be used with canister or cylindrical bottle. The preferred pump for this application is the cylindrical Euromist II® from Seaquest Dispensing.

Regardless of the particular commercial spray nozzle used, it is preferable for the atomization spray nozzle to have an orifice diameter of from about 0.1 mm to about 2 mm, and most preferably from about 0.15 mm to about 1 mm. The spraying step is conducted for a period of time of from about 5 minutes to about 30 minutes, more preferably from about 5 minutes to about 20 minutes. Spraying times will vary depending upon the various operating parameters selected as described herein.

For use herein, it is preferred that said spray dispenser comprises a trigger spray device. More preferably, the spray dispenser should be capable of providing droplets with a weight average diameter of from 8 to 100 $\mu$m, preferably from 10–60 $\mu$m (more preferably from 20–60 $\mu$m) for automatic sprayer, and preferably from 50–100 $\mu$m for manually activated sprayer.

F. Method of Use

An effective amount of the composition of the present invention is preferably sprayed onto fabrics, particularly clothing. When the composition is sprayed onto fabric an effective amount should be deposited onto the fabric without causing saturation of the fabric, typically from 3% to 85%, preferably from 5% to 50%, more preferably from 5% to 25%, by weight of the fabric. The amount of total active typically sprayed onto the fabric is from 0.01% to 3%, preferably from 0.1% to 2%, more preferably from 0.1% to 1%, by weight of the fabric. Once an effective amount of the composition is sprayed onto the fabric the fabric is optionally, but preferably stretched. The fabric is typically stretched perpendicular to the wrinkle. The fabric can also be smoothed by hand after it has been sprayed. The smoothing movement works particularly well on areas of clothing that have interface sewn into them, or on the hem of clothing. Once the fabric has been sprayed and optionally, but preferably, stretched, it is hung until dry.

Accordingly, there is provided a method for reducing wrinkles on fabrics which comprises the steps of contacting the fabrics with a composition of the invention, as defined herein before.

By "contacting", it is meant any steps that is suitable for providing a contact of the composition with the fabric. This can include by soaking, washing, rinsing, and/or spraying as well as by means of a dryer sheet onto which is adsorbed the composition.

The composition of the present invention can also be used as an ironing aid. An effective amount of the composition can be sprayed onto fabric, wherein said fabric should not be sprayed to saturation. The fabric can be ironed at the normal temperature at which it should be ironed. The fabric can be sprayed with an effective amount of the composition, allowed to dry and then ironed, or sprayed and ironed immediately.

In a still further aspect of the invention, the composition can be sprayed onto fabrics by means of an in-home de-wrinkling apparatus containing the fabric to be dewrinkled, thereby providing ease of operation. Conventional personal as well as industrial de-wrinkling apparatus are suitable for use herein. Traditionally, these apparatus act by a steaming process which provides a relaxing of the fibers. The spraying of the composition or compounds on the fabrics can then occurs within the chamber of the apparatus or before placing the fabrics into the chamber. Again, the spraying means should preferably be capable of providing droplets with a mean diameter of from 3 to 50 $\mu$m, preferably from 5–30 $\mu$m for automatic sprayer, and preferably from 50–100 $\mu$m for manually activated sprayer. Preferably, the loading of moisture on fabrics made of natural and synthetic fibers is from 5 to 25%, more preferably from 5 to 10% by weight of the dried fabric. Other conventional steps for the dewrinkling apparatus can be applied such as heating and drying. Optionally, for optimum dewrinkling benefit, the temperature of the conditioning composition can be heated to enhance distribution and deposition of the conditioning composition on the garments. In that regard, the temperature of the conditioning composition can be as low as room temperature, and preferably is from 35° C. to 80° C., more preferably from 40–70° C. By having the conditioning composition at the aforementioned elevated temperatures, it has been found that superior de-wrinkling benefits are achieved. It should be understood that the temperature of the conditioning composition can be from about ambient (15° C.) temperature to about 80° C., and higher temperatures generally improve de-wrinkling performance.

It has also been found that effective softening composition distribution on the garments, e.g inside the cabinet, can be further enhanced by optimally selecting the fluid surface tension of the softening composition. For example, it is preferable for the softening composition to have fluid surface tension of from about 5 dynes/cm to about 60 dynes/cm, more preferably of from about 20 dynes/cm to about 55 dynes/cm, and most preferably, from about 20 dynes/cm to about 30 dynes/cm. The lower surface tension of the softening composition improves effective distribution by improving surface absorption and spreading of the softening composition on the garment fabric.

Furthermore, it is preferable for the softening composition to have a fluid viscosity of from about 1 cps to about 100 cps, more preferably from about 1 cps to about 50 cps, and most preferably of from about 1 cps to about 20 cps as measured by a standard Brookfield viscometer.

In the examples, the abbreviated component identifications have the following meanings:

Wetting agent 1: N,N dimethyl-N-(2-hydroxyethyl)-N-dodecyl/tetradecyl ammonium bromide Wetting agent 2: C12/C14 Choline ester Wetting agent 3: C8/C12 dimethyl, hydroxyethyl quaternary ammonium salt Lubricant: N,N-di-(canolyl-oxy-ethyl)-N-methyl-N-(2-hydroxyethyl)ammonium methyl sulfate Cyclodextrin: Hydroxypropyl beta-cyclodextrin preservative: Kathon Dye fixative: Cationic dye fixing agent (50% active) available under the tradename Tinofix Eco from Ciba-Geigy Carezyme: Cellulytic enzyme of activity 1000 CEVU/g sold by NOVO Industries A/S and of activity mentioned above unless otherwise specified Nonionic: Silwet L-7600 commercially available from OSi Specialties The invention is illustrated in the following non limiting examples, in which all percentages are on a weight basis unless otherwise stated.

EXAMPLE I

| | A | B | C | D | E | F | G | H | I |
|---|---|---|---|---|---|---|---|---|---|
| Glycerol | 0.75% | — | — | — | — | | | | |
| Sorbitol | | | | | | 0.7% | — | — | — |
| Propylene glycol | — | 0.50% | — | — | — | 3.0% | — | | |
| Ethylene glycol | | | | | | — | — | 0.6% | 1.0% |
| Di-ethylene glycol | — | — | 0.75% | 0.75% | 0.75% | | | | |
| Wetting agent 1 | 0.33% | 0.33% | — | 0.33% | — | — | — | 1.5% | — |
| Wetting agent 2 | — | — | 0.40% | — | 0.40% | — | 0.3% | — | — |
| wetting agent 3 | | | | | | 0.7% | — | — | 0.5% |
| Nonionic | — | — | 0.25% | — | 0.25% | | | | |
| Sodium sulphate | 0.75% | — | — | — | 0.75% | | | | |
| Lubricant | — | — | — | 0.40% | — | | | | |
| Cyclodextrin | 1.00% | 1.00% | — | 1.00% | 1.00% | | | | |
| Preservative | 3 ppm | 3 ppm | — | 3 ppm | 3 ppm | | | | |
| Magnesium sulphate | | | | | | 0.7% | — | 3.0% | — |
| Sodium borate | | | | | | — | — | — | 1.0% |
| Sodium citrate | | | | | | — | 2.0% | — | — |
| Dye fixative | | | | | | — | 0.5% | — | — |
| Carezyme | | | | | | — | 0.1% | — | — |
| Perfume | 0.10% | 0.10% | — | 0.10% | 0.10% | 0.15% | 0.3% | 0.1% | 0.4% |
| Water | Balance | Balance | Balance | Balance | Balance | Balance | Balance | Balance | Balance |

What is claimed is:

1. A wrinkle reducing composition, comprising:

(A) a wrinkle reducing active, comprising a nonionic polyhydric alcohol humectant and a water-soluble wetting agent selected from the group consisting of a cationic surfactant, a non-alkoxylated nonionic surfactant, and an anionic surfactant;

(B) at least one material selected from the group consisting of:

a salt having the formula: AM, wherein A is a cation selected from the group consisting of sodium, calcium, potassium, and magnesium, and M is an anion selected from the group consisting of sulfate, chloride, nitrate, carbonate, borate, and carboxylate;

uncomplexed cyclodextrin; and a lubricant selected from the group consisting of a water-insoluble cationic softener, cyclomethicones, and fatty acid esters of mono- or polyhydric alcohols or anhydride thereof containing from 1 to 8 carbon atoms; and (C) a liquid aqueous carrier.

2. A composition according to claim 1, wherein said wetting agent is a cationic surfactant.

3. A composition according to claim 2, wherein said wetting agent is a cationic surfactant, of formula:

$$[R^1N^-R3]X^-$$

wherein $R^1$ is $C_{10}$–$C_{22}$ hydrocarbon group, or the corresponding ester linkage interrupted group with a $C_1$–$C_4$ alkylene group between the ester linkage and the N, each R is a $C_1$–$C_4$ alkyl or substituted alkyl, or hydrogen, and the counterion $X^-$ is a softener compatible anion.

4. A composition according to claim 1, wherein said cationic surfactant is a choline ester.

5. A composition according to claim 4, is of formula:

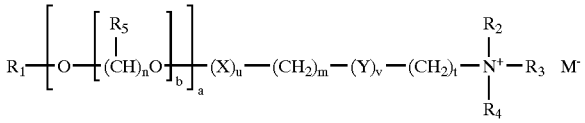

wherein $R_1$ is a $C_{10}$–$C_{22}$, preferably a $C_{12}$–$C_{14}$ linear or branched alkyl, alkenyl or alkaryl chain or $M^-$, $N^+(R_6R_7R_8)(CH_2)_s$; X and Y, independently, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$, and $R_8$ are independently selected from the group consisting of alkyl, alkenyl, hydroxyalkyl and hydroxy-alkenyl groups having from 1 to 4 carbon atoms and alkaryl groups; and $R_5$ is independently H or a $C_1$–$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion.

6. A composition according to claim 1, wherein said wetting agent is an anionic surfactant.

7. A composition according to claim 1, wherein said wetting agent is present in an amount of from 0.1 to 10% by weight of the composition.

8. A composition according to claim 7, wherein said wetting agent is present in an amount of from 0.1 to 5% by weight of the composition.

9. A composition according to claim 8, wherein said wetting agent is present in an amount of from 0.1 to 1.5% by weight of the composition.

10. A composition according to claim 1, wherein the nonionic polyhydric compound is a polyol having from 2 to 8 hydroxy groups.

11. A composition according to claim 10, wherein said nonionic polyhydric compound is selected from glycerol, ethylene glycol, propylene glycol, diethylene glycol, dipropylene glycol, sorbitol, erytritol or mixtures thereof.

12. A composition according to claim 1, wherein the nonionic humectant is present in amount of from 0.1 to 10% by weight of the composition.

13. A composition according to claim 12, wherein the nonionic humectant is present in amount of from 0.1 to 5% by weight of the composition.

14. A composition according to claim 13, wherein the nonionic humectant is present in amount of from 0.1 to 1.5% by weight of the composition.

15. A composition according to claim 1, wherein the water of the liquid aqueous carrier comprises from 50% to 95% by weight of the composition.

16. A composition according to claim 15, wherein the water of the liquid aqueous carrier comprises from 60% to 97% by weight of the composition.

17. A composition according to claim 16, wherein the water of the liquid aqueous carrier comprises from 70% to 99% by weight of the composition.

18. A composition according to claim 1, wherein said composition further comprises an alkoxylated nonionic surfactant.

19. A composition according to claim 18, wherein said alkoxylated non-ionic surfactant comprises a polyalkyleneoxide polysiloxane surfactant, a block copolymer of ethylene oxide and propylene oxide based on ethylene glycol, propylene glycol, glycerol, trimethylolpropane, or ethylenediamine, or mixtures thereof.

20. A composition according to claim 1, wherein said composition has a fluid surface tension of from about 20 dynes/cm to about 55 dynes/cm.

21. A composition according to claim 1, wherein said composition has a fluid viscosity of from about 1 cps to about 50 cps.

22. A method for reducing or removing wrinkles on fabrics which comprises the steps of contacting the fabrics with a composition according to claim 1.

23. A method for reducing or removing wrinkles on fabrics and malodours on fabrics which comprises the steps of contacting the fabrics with a composition comprising A. a wrinkle reducing active, comprising a nonionic polyhydric alcohol humectant and a water-soluble wetting agent selected from a cationic surfactant, a non-alkoxylated nonionic surfactant and an anionic surfactant;

B. an uncomplexed cyclodextrin; and

C. a liquid aqueous carrier.

24. A method according claim 22, wherein the composition is contacted with the fabrics by means of a spray dispenser.

25. A method according to claim 22, wherein the fabrics are placed into a dewrinkling apparatus.

26. A method according to claim 8, wherein the apparatus comprises spraying means capable of providing droplets with a mean diameter of 3 to 50 μm.

27. A packaged composition comprising the composition of claim 1, in a spray dispenser.

28. A packaged composition according to claim 27 or method according to claim 24, wherein said spray dispenser comprises a trigger spray device and is capable of providing droplets with a weight average diameter of from 8 to 100 μm.

29. A method according to claim 24, wherein said spray dispenser comprises a trigger spray device and is capable of providing droplets with a weight average diameter of from 8 to 100 μm.

30. A wrinkle reducing composition, comprising:

A. a wrinkle reducing active, comprising a nonionic polyhydric alcohol humectant and a water-soluble wetting agent selected from a cationic surfactant, a non-alkoxylated nonionic surfactant and an anionic surfactant; provided that when said water-soluble wetting agent is a cationic surfactant comprising a choline ester, said choline ester has the structure:

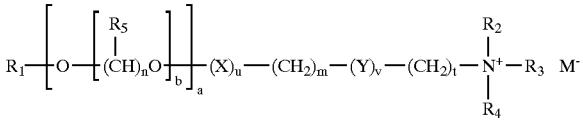

wherein $R_1$ is a $C_{10}$–$C_{22}$, preferably a $C_{12}$–$C_{14}$ linear or branched alkyl, alkenyl or alkaryl chain or $M^-$, $N^+(R_6R_7R_8)(CH_2)_s$; X and Y, independently, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$, and $R_8$ are independently selected from the group consisting of alkyl, alkenyl, hydroxyalkyl and hydroxy-alkenyl groups having from 1 to 4 carbon atoms and alkaryl groups; and $R_5$ is independently H or a $C_1$–$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion; and B. a liquid aqueous carrier.

31. A composition according to claim 30, wherein said composition further comprises a lubricant selected from a water-insoluble cationic softener, nonionic softener selected from cyclomethicones, fatty acid esters of mono- or polyhydric alcohols or anhydride thereof containing from 1 to 8 carbon atoms.

32. A composition according to claim 30, wherein said composition further comprises a salt having the formula: AM, wherein A is a cation selected from the group consisting of sodium, calcium, potassium, and magnesium, and M is an anion selected from the group consisting of sulfate, chloride, nitrate, carbonate, borate, and carboxylate.

33. A composition according to claim 30, wherein said composition further comprises an uncomplexed cyclodextrin.

34. A composition according to claim 30, wherein said composition further comprises an alkoxylated nonionic surfactant.

35. A composition according to claim 34, wherein said alkoxylated nonionic surfactant comprises a polyalkyleneoxide polysiloxane surfactant, a block copolymer of ethylene oxide and propylene oxide based on ethylene glycol, propylene glycol, glycerol, trimethylolpropane, or ethylenediamine, and mixtures thereof.

36. A composition according to claim 30, wherein the nonionic polyhydric compound is a polyol having from 2 to 8 hydroxy groups.

37. A composition according to claim 30, wherein said nonionic polyhydric compound is selected from glycerol, ethylene glycol, propylene glycol, diethylene glycol, dipropylene glycol, sorbitol, erythritol or mixtures thereof.

* * * * *